US010598400B2

(12) United States Patent
Saiki et al.

(10) Patent No.: US 10,598,400 B2
(45) Date of Patent: Mar. 24, 2020

(54) REMOTE CONTROL DEVICE

(71) Applicant: Mitsubishi Electric Corporation, Tokyo (JP)

(72) Inventors: Nobuyuki Saiki, Tokyo (JP); Kazuo Maeda, Tokyo (JP); Masaoki Ino, Tokyo (JP); Masatoshi Kawamura, Tokyo (JP); Yuki Hanaeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 402 days.

(21) Appl. No.: 14/899,783

(22) PCT Filed: Oct. 9, 2013

(86) PCT No.: PCT/JP2013/077422
§ 371 (c)(1),
(2) Date: Dec. 18, 2015

(87) PCT Pub. No.: WO2015/052786
PCT Pub. Date: Apr. 16, 2015

(65) Prior Publication Data

US 2016/0138820 A1 May 19, 2016

(51) Int. Cl.
*G05D 23/00* (2006.01)
*F24F 11/62* (2018.01)
(Continued)

(52) U.S. Cl.
CPC ..... *F24F 11/62* (2018.01); *F24F 11/30* (2018.01); *F24F 11/52* (2018.01); *F24F 11/56* (2018.01)

(58) Field of Classification Search
CPC .... F24F 13/08; F24F 13/10; F24F 2011/0073; F24F 11/0086; F24F 11/62; F24F 11/006;
(Continued)

(56) References Cited

U.S. PATENT DOCUMENTS 5,180,333 A * 1/1993 Shyu ..... F24F 11/00 236/49.3
8,172,153 B1 * 5/2012 Kennedy ..... F24D 19/1048 236/1 B
(Continued)

FOREIGN PATENT DOCUMENTS

JP H02-264597 A 10/1990
JP H05-076087 A 3/1993
(Continued)

OTHER PUBLICATIONS

Office Action dated May 9, 2017 issued in corresponding CN patent application No. 201380078343.3 (and English translation).
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

A remote control device according to the present invention includes an operation unit for switching and setting an operation state of an apparatus performing at least one of a heating operation and a cooling operation, a display unit that displays a screen on which an operation at the operation unit is reflected, and a controller that controls a display operation of the display unit. The controller causes the display unit to display at least one of a type and a range of an operation state that is able to be switched and set by the operation unit.

8 Claims, 7 Drawing Sheets

(51) Int. Cl.
*F24F 11/30* (2018.01)
*F24F 11/52* (2018.01)
*F24F 11/56* (2018.01)

(58) Field of Classification Search
CPC ..... F24F 2011/0091; F25B 2600/112; F25D 17/045; G06F 3/0486; G06F 3/0488; G06F 3/04847
USPC ..... 236/94
See application file for complete search history.

(56) References Cited

U.S. PATENT DOCUMENTS

| | | | | |
|---|---|---|---|---|
| 8,556,188 | B2 * | 10/2013 | Steinberg | F24F 11/0034 165/237 |
| 9,002,523 | B2 * | 4/2015 | Erickson | F24F 11/30 700/276 |
| 9,122,283 | B2 * | 9/2015 | Rylski | G05D 23/1905 |
| 2011/0132991 | A1 * | 6/2011 | Moody | G05D 23/1902 236/46 R |
| 2012/0131504 | A1 * | 5/2012 | Fadell | F24D 19/1084 715/810 |
| 2015/0094865 | A1 * | 4/2015 | Choi | G06F 3/0488 700/278 |

FOREIGN PATENT DOCUMENTS

| | | | |
|---|---|---|---|
| JP | H05-126387 | A | 5/1993 |
| JP | H07-019584 | A | 1/1995 |
| JP | 2000-257943 | A | 9/2000 |
| JP | 3108163 | B2 | 11/2000 |
| JP | 2001-153440 | A | 6/2001 |
| JP | 3453791 | B2 | 10/2003 |
| JP | 2006-029687 | A | 2/2006 |
| JP | 2009-002593 | A | 1/2009 |
| WO | 2007/091825 | A1 | 8/2007 |
| WO | 2011/162206 | A1 | 12/2011 |

OTHER PUBLICATIONS

Office Action dated Jul. 26, 2016 issued in corresponding JP patent application No. 2015-541345 (and English translation).
Extended European Search Report dated Apr. 18, 2017 in the corresponding EP patent application No. 13895440.9.
International Search Report of the International Searching Authority dated Jan. 7, 2014 for the corresponding international application No. PCT/JP2013/077422 (and English translation).
Office Action dated Dec. 13, 2017 issued in corresponding CN patent application No. 201380078343.3 (and English translation).
Office action dated Apr. 13, 2018 issued in corresponding CN patent application No. 201380078343.3 (and English translation attached).
Office Action dated Aug. 23, 2019 issued in corresponding CN patent application No. 201380078343.3 (and English translation).
Office Action dated Aug. 27, 2019 issued in corresponding EP patent application No. 13895440.9.
Reexamination Assessment dated Nov. 19, 2019 issued in corresponding CN patent application No. 201380078343.3 (and English machine translation of summary).

* cited by examiner

REMOTE CONTROL DEVICE

CROSS REFERENCE TO RELATED APPLICATION

This application is a U.S. national stage application of International Application No. PCT/JP2013/077422 filed on Oct. 9, 2013, the disclosure of which is incorporated herein by reference.

TECHNICAL FIELD

The present invention relates to a remote control device.

BACKGROUND ART

To apparatuses such as air-conditioning apparatuses, cooling energy apparatuses, and water heaters (hereinafter, described as air-conditioning apparatuses or the like), that is, apparatuses that perform at least one of a heating operation and a cooling operation, a remote control device is often attached so that a user or the like can set an operation state from a remote point. The user or the like can perform, for example, setting of operation and stop, setting of an operation mode, setting of an operation schedule, and other settings for various operations, by operating an operation unit provided at the remote control device. Furthermore, the user or the like can confirm the setting state, by viewing a display unit provided at the remote control device (see, for example, Patent Literatures 1, 2, and so on).

For example, in the case where the remote control device is a remote control device for an air-conditioning apparatus, for example, buttons for setting operation and stop, a button for setting a set temperature, a button for setting an operation mode, a button for setting the wind direction, and other buttons are provided as the operation unit. For example, to change the operation state of the current indoor unit "operation, set temperature_23 degrees C., operation mode_cooling, and wind direction_downwards" into an operation state "operation, set temperature_25 degrees C., operation mode_heating, and wind direction_upwards", the user or the like presses a button for increasing the set temperature twice to switch the set temperature from 23 degrees C. into 25 degrees C., presses a button for changing the operation mode three times to switch the operation mode in the order of cooling, drying, air-sending, and heating, and presses a button for changing the wind direction once to switch the wind direction from downward to upward.

CITATION LIST

Patent Literature

Patent Literature 1: Japanese Unexamined Patent Application Publication No. 2006-29687 (FIG. 3)

Patent Literature 2: Japanese Unexamined Patent Application Publication No. 2-264597 (FIG. 1)

SUMMARY OF INVENTION

Technical Problem

In such a remote control device, the type, range, and the like of operation state that may be set can be known only after the operation unit is actually operated. Therefore, the user or the like needs to unnecessarily press a button to set the operation state and press the button tentatively, and this causes a problem that the efficiency of a setting operation is low. Furthermore, since the user or the like needs to operate the air-conditioning apparatus or the like to confirm the type, range, and the like of operation state that may be set, there is a problem that the efficiency of a confirmation operation is low.

The present invention has been made in light of the above problems, and obtains a remote control device with improved efficiency of a setting operation and a confirmation operation.

Solution to Problem

A remote control device according to the present invention includes an operation unit for switching and setting an operation state of an apparatus performing at least one of a heating operation and a cooling operation; a display unit that displays a screen on which an operation at the operation unit is reflected; and a controller that controls a display operation of the display unit. The controller causes the display unit to display at least one of a type and a range of an operation state that is able to be switched and set by the operation unit.

Advantageous Effects of Invention

In the remote control device according to the present invention, the controller causes the display unit to display at least one of the type and the range of operation state that may be switched and set by the operation unit. Therefore, the situation in which the user or the like unnecessarily presses a button or presses a button tentatively or other situations are suppressed, and the efficiency of a setting operation may thus be improved. Furthermore, the user or the like is able to confirm at least one of the type and the range of operation state that may be set, without operating the air-conditioning apparatus or the like, and the efficiency of a confirmation operation may thus be improved.

DESCRIPTION OF EMBODIMENTS

Hereinafter, remote control devices according to embodiments will be described with reference to the drawings.

Configurations, operations, and the like explained below are merely examples. Remote control devices according to the present invention are not limited to cases with such configurations, operations, and the like. Furthermore, explanation for detailed configurations, operations, and the like are simplified or omitted in an appropriate manner. Furthermore, redundant and similar explanations will be simplified or omitted in an appropriate manner.

Embodiment 1

A remote control device according to Embodiment 1 will be described.

<Configuration and Operation of Remote Control Device>

A configuration and an operation of the remote control device according to Embodiment 1 will be described.

Figure 1:
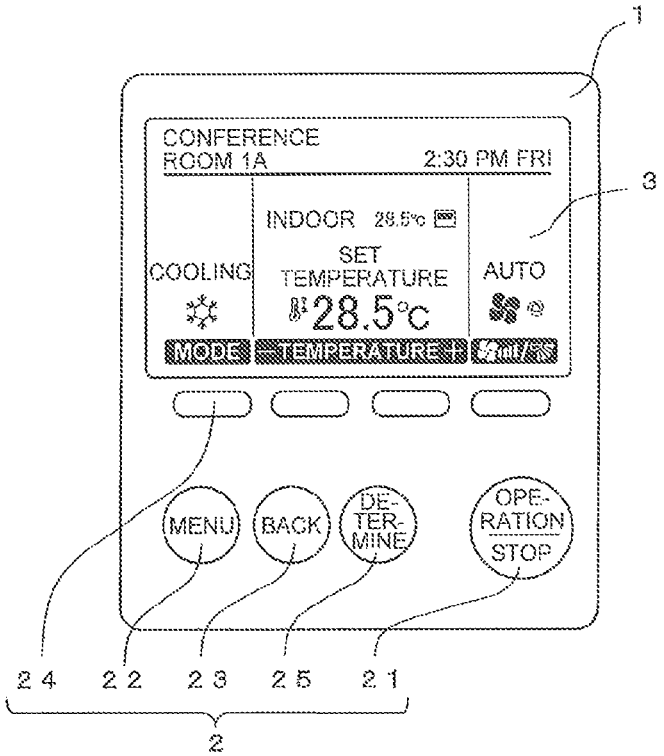
FIG. 1 is a diagram illustrating the external appearance of a remote control device according to Embodiment 1.
Figure 2:
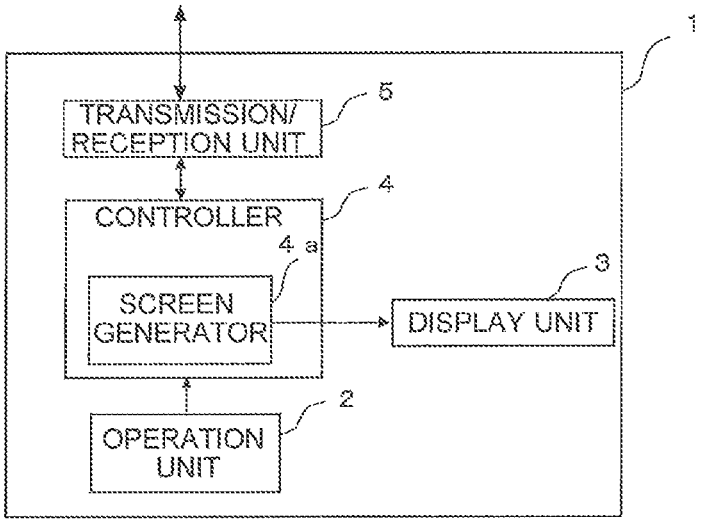
FIG. 2 is a diagram illustrating the system configuration of the remote control device according to Embodiment 1.

FIG. 1 is a diagram illustrating the external appearance of the remote control device according to Embodiment 1. FIG. 2 is a diagram illustrating the system configuration of the remote control device according to Embodiment 1.

As illustrated in FIGS. 1 and 2, a remote control device 1 includes an operation unit 2, a display unit 3, a controller 4, and a transmission/reception unit 5.

The operation unit 2 includes an operation/stop button 21 for switching between operation and stop of the air-conditioning apparatus or the like, a menu button 22 for displaying a menu screen on the display unit 3, a back button 23 for displaying on the display unit 3 the last screen displayed before the screen that is currently being displayed, multiple function buttons 24 for switching settings on the screen displayed on the display unit 3, and a determination button 25 for determining the selection made on the display unit 3. The operation unit 2 may include an up key, which is specified for increasing a set value or moving a cursor displayed on the display unit 3 upwards. Furthermore, the operation unit 2 may include a down key, which is specified for decreasing a set value or moving a cursor displayed on the display unit 3 downwards. Furthermore, the operation unit 2 may include a cross key, which is used for increasing or decreasing a set value or moving a cursor displayed on the display unit 3 vertically and horizontally. At the center of the cross key, a button functioning as a determination button may be provided.

Information input by an operation on the operation unit 2 by the user or the like is output to the controller 4. Furthermore, the controller 4 receives operation information and other types of information from the air-conditioning apparatus or the like via the transmission/reception unit 5. The controller 4 generates, with a screen generator 4*a*, a screen that reflects the above information, and outputs the generated screen to the display unit 3. Furthermore, when settings are switched due to an operation on the operation unit 2 by the user or the like, the controller 4 transmits new setting information to the air-conditioning apparatus or the like. The display unit 3 displays the screen received from the screen generator 4*a*. The display unit 3 is, for example, a liquid crystal display, a PDP display, an organic EL display, an LED display, a CRT display, or other types of display. When the display unit 3 is a liquid crystal display, the screen may be displayed in a dot matrix form.

The remote control device 1 may be attached to an indoor wall surface or other places in a fixed manner or may be freely portable. Furthermore, the transmission/reception unit 5 may be connected to the air-conditioning apparatus or the like in a wired manner or may be connected to the air-conditioning apparatus or the like in a wireless manner. Furthermore, the display unit 3 may be a touch panel or the like. That is, all or part of the operation unit 2 may be incorporated as a soft key into the screen displayed on the display unit 3.

Figure 3:
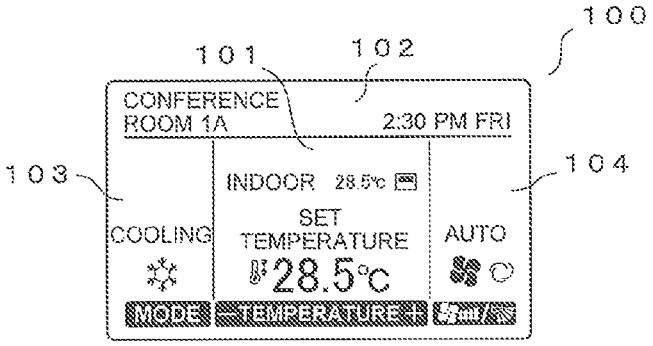
FIG. 3 is a diagram illustrating an example of a main screen displayed on a display unit of the remote control device according to Embodiment 1.

FIG. 3 is a diagram illustrating an example of a main screen displayed on the display unit of the remote control device according to Embodiment 1.

During a normal operation, the display unit 3 displays a main screen 100, as illustrated in FIG. 3. The main screen 100 is divided into a central section 101, an upper section 102, a left section 103, and a right section 104. In the central section 101, the setting state of a set temperature, the indoor temperature, and other information are displayed. In the upper section 102, the name of the remote controller, the date and time, and other information are displayed. In the left section 103, the setting state of the operation mode and other information are displayed. In the right section 104, the setting state of the wind direction, the wind speed, and other information are displayed. The user or the like is able to switch the setting state, such as the set temperature, the operation mode, the wind direction, and the wind speed, by pressing the function button 24 in the state in which the main screen 100 is being displayed on the display unit 3. For example, the user or the like is able to reduce the set temperature of the air-conditioning apparatus or the like by pressing the function button 24 that is located below "–" displayed as a void character, from among the multiple function buttons 24, and increase the set temperature of the air-conditioning apparatus or the like by pressing the function button 24 that is located below "+" displayed as a void character. The main screen 100 corresponds to an "operation screen" according to the present invention.

Figure 4:
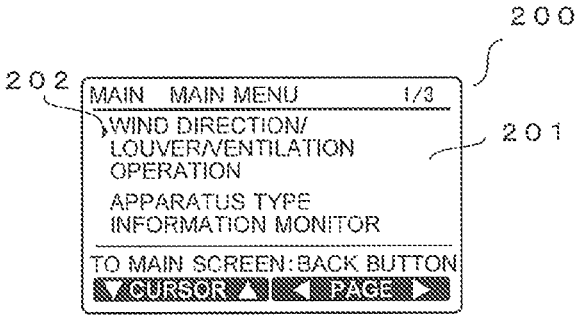
FIG. 4 is a diagram illustrating an example of a menu screen displayed on the display unit of the remote control device according to Embodiment 1.

FIG. 4 is a diagram illustrating an example of a menu screen displayed on the display unit of the remote control device according to Embodiment 1.

When the user or the like presses the menu button 22, the display unit 3 displays a menu screen 200, as illustrated in FIG. 4. In an item display section 201 of the menu screen 200, items that may be executed by the user or the like are displayed as a list. When the user or the like presses the function button 24 to move a cursor 202 to a position beside a desired item and presses the determination button 25, the display unit 3 displays a screen for performing detailed settings of the operation state of the air-conditioning apparatus or the like, confirmation of apparatus type information of the air-conditioning apparatus or the like, and other types of processing.

Figure 5:
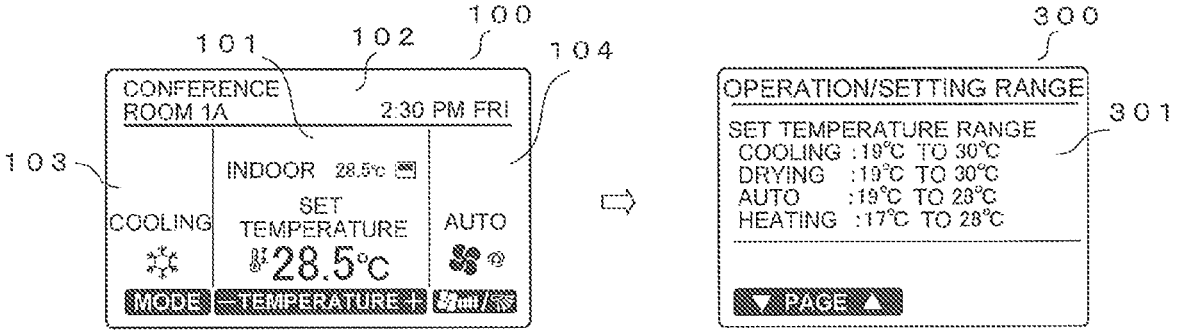
FIG. 5 is a diagram for explaining an operation of the display unit of the remote control device according to Embodiment 1.

FIG. 5 is a diagram for explaining an operation of the display unit of the remote control device according to Embodiment 1.

As illustrated in FIG. 5, when the user or the like presses the function button 24 for changing the set temperature in a specific pressing manner registered in advance (for example, single pressing, continuous pressing for three seconds, double pressing, or other types of pressing) in the state in which the main screen 100 is being displayed on the display unit 3, the display unit 3 displays a set temperature setting range display screen 300 that displays the range of the set temperature that may be set by the user or the like.

In a central section 301 of the set temperature setting range display screen 300, each operation mode and the range of the set temperature that may be set are displayed in association with each other. At this time, the range of the set temperature that corresponds to the currently set operation mode may be displayed with emphasis. For example, when the set temperature setting range display screen 300 is displayed in the state in which the operation mode is set to cooling (cooling operation), the letters "cooling", the letters "19 degrees C. to 30 degrees C." or the letters "cooling: 19 degrees C. to 30 degrees C." may be displayed in a flashing manner. Furthermore, only the range of the set temperature that corresponds to the currently set operation mode may be displayed. With this operation, the user or the like is able to understand the currently set operation mode, without returning to the previous screen.

<Effects of Remote Control Device>

Effects of the remote control device according to Embodiment 1 will be described.

In the remote control device 1, the user or the like is able to change the set temperature after confirming the range of the set temperature that may be set in each operation mode. Therefore, a situation in which the user or the like unnecessarily presses a button or presses a button tentatively or other situations are suppressed, and the efficiency of a setting operation may thus be improved. Furthermore, the user or the like is able to display the set temperature setting range display screen 300 with a simple operation in the state in which the main screen 100 is being displayed, without operating the air-conditioning apparatus or the like. Therefore, the efficiency of an operation for confirming the range of the set temperature that may be set may be improved. Furthermore, on the set temperature setting range display screen 300, the user or the like is able to understand the currently set operation mode. Therefore, a complicated operation such as switching of the screen may be reduced, and the efficiency of a setting operation and a confirmation operation may thus be improved.

Embodiment 2

A remote control device according to Embodiment 2 will be described.

Hereinafter, redundant explanations and explanations similar to Embodiment 1 will be simplified or omitted in an appropriate manner.

<Configuration and Operation of Remote Control Device>

A configuration and an operation of the remote control device according to Embodiment 2 will be described.

Figure 6:
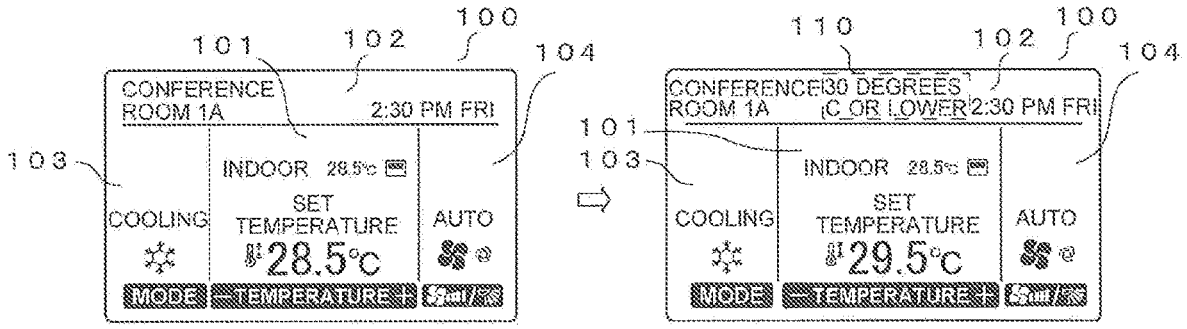
FIG. 6 is a diagram for explaining an operation of a display unit of a remote control device according to Embodiment 2.
Figure 7:
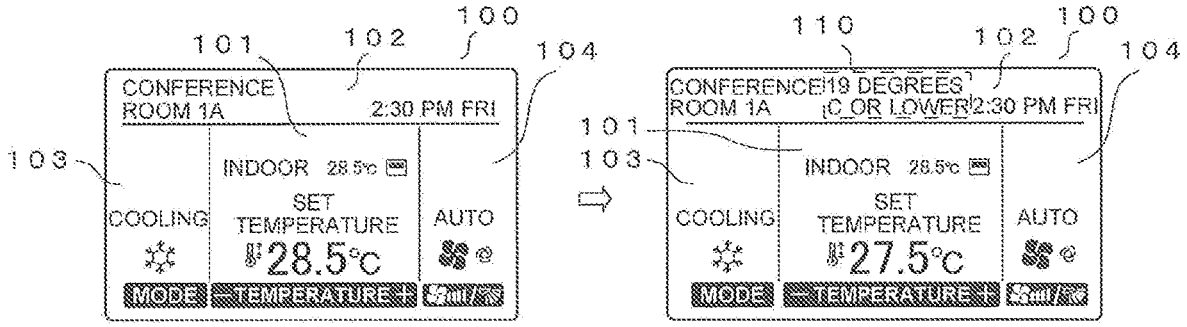
FIG. 7 is a diagram for explaining an operation of the display unit of the remote control device according to Embodiment 2.

FIGS. 6 and 7 are diagrams for explaining operations of a display unit of the remote control device according to Embodiment 2.

As illustrated in FIG. 6, when the user or the like presses the function button 24 that is located below "+" displayed as a void character in a specific pressing manner registered in advance (for example, single pressing, continuous pressing for three seconds, double pressing, or other types of pressing) in the state in which the main screen 100 is being displayed on the display unit 3, the display unit 3 displays an upper limit value of the range of the set temperature that corresponds to the currently set operation mode in a set temperature setting range display part 110 that is provided in a blank of the main screen 100. Furthermore, as illustrated in FIG. 7, when the user or the like presses the function button 24 that is located below "−" displayed as a void character in a specific pressing manner registered in advance (for example, single pressing, continuous pressing for three seconds, double pressing, or other types of pressing) in the state in which the main screen 100 is being displayed on the display unit 3, the display unit 3 displays a lower limit value of the range of the set temperature that corresponds to the currently set operation mode in the set temperature setting range display part 110 that is provided in the blank of the main screen 100.

In the set temperature setting range display part 110, the upper limit value or the lower limit value may be displayed in a flashing manner or a steady manner. Furthermore, the set temperature setting range display part 110 may be provided at a position different from the central part of the upper section 102. When the set temperature setting range display part 110 is provided at the central part of the upper section 102, emphasis display may be presented to the user or the like.

<Effects of Remote Control Device>

Effects of the remote control device according to Embodiment 2 will be described.

In the remote control device 1, the user or the like is able to change the set temperature after confirming the range of the set temperature that may be set in each operation mode. Therefore, the situation in which the user or the like unnecessarily presses a button or presses a button tentatively or other situations are suppressed, and the efficiency of a setting operation may thus be improved. Furthermore, the user or the like is able to display the upper limit value or the lower limit value in the set temperature setting range display part 110 with a simple operation in the state in which the main screen 100 is being displayed, without operating the air-conditioning apparatus or the like. Therefore, the efficiency of an operation for confirming the range of the set temperature that may be set may be improved. Furthermore, on main screen 100, the user or the like able to understand the range of the set temperature that may be set. Therefore, a complicated operation such as switching of the screen may be reduced, and the efficiency of a setting operation and a confirmation operation may be thus improved.

Embodiment 3

A remote control device according to Embodiment 3 will be described.

Hereinafter, redundant explanations and explanations similar to Embodiment 1 and Embodiment 2 will be simplified or omitted in an appropriate manner.

<Configuration and Operation of Remote Control Device>

A configuration and an operation of the remote control device according to Embodiment 3 will be described.

Figure 8:
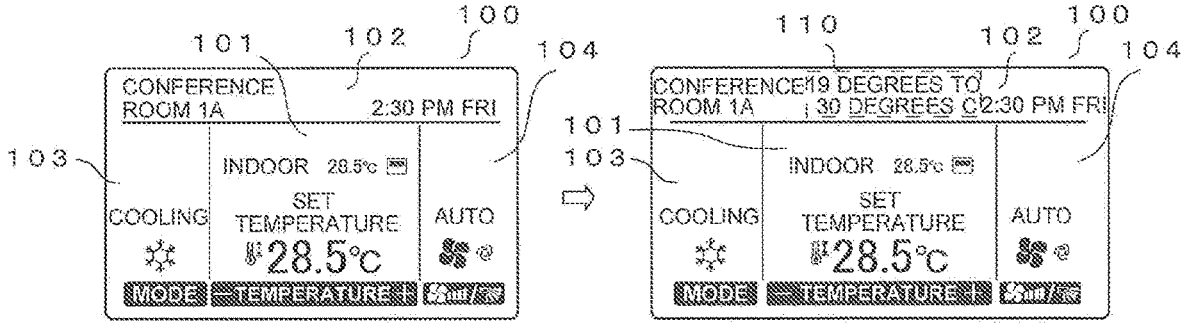
FIG. 8 is a diagram for explaining an operation of a display unit of a remote control device according to Embodiment 3.

FIG. 8 is a diagram for explaining an operation of a display unit of the remote control device according to Embodiment 3.

As illustrated in FIG. 8, when the user or the like presses the function button 24 that is located below "+" displayed as a void character or the function button 24 that is located below "−" displayed as a void character in a specific pressing manner registered in advance (for example, single pressing, continuous pressing for three seconds, double pressing, or other types of pressing) in the state in which the main screen 100 is being displayed on the display unit 3, the display unit 3 displays an upper limit value or a lower limit value of the range of the set temperature that corresponds to the currently set operation mode in the set temperature setting range display part 110 that is provided in a blank of the main screen 100.

In the set temperature setting range display part 110, the upper limit value and the lower limit value may be displayed in a flashing manner or a steady manner. Furthermore, the set temperature setting range display part 110 may be provided at a position different from the central part of the upper section 102. When the set temperature setting range display part 110 is provided at the central part of the upper section 102, emphasis display may be presented to the user or the like.

<Effects of Remote Control Device>

Effects of the remote control device according to Embodiment 3 will be described.

In the remote control device 1, the user or the like is able to change the set temperature after confirming the range of the set temperature that may be set in each operation mode. Therefore, the situation in which the user or the like unnecessarily presses a button or presses a button tentatively or other situations are suppressed, and the efficiency of a setting operation may thus be improved. Furthermore, the user or the like is able to display the upper limit value and the lower limit value in the set temperature setting range display part 110 with a simple operation in the state in which the main screen 100 is being displayed, without operating the air-conditioning apparatus or the like. Therefore, the efficiency of an operation for confirming the range of the set temperature that may be set may be improved. Furthermore, on main screen 100, the user or the like is able to understand the range of the set temperature that may be set. Therefore, a complicated operation such as switching of the screen may be reduced, and the efficiency of a setting operation and a confirmation operation may thus be improved. Furthermore, both the upper limit value and the lower limit value are displayed in the set temperature setting range display part 110. Therefore, for example, even in the case where the user or the like intends to switch between increasing and decreasing of the set temperature after pressing the function button 24, the user or the like does not need to re-perform an operation for displaying the range of the set temperature that may be set on the display unit 3, and the efficiency of a setting operation and a confirmation operation may thus be improved.

Embodiment 4

A remote control device according to Embodiment 4 will be described.

Hereinafter, redundant explanations and explanations similar to Embodiment 1 to Embodiment 3 will be simplified or omitted in an appropriate manner.

<Configuration and Operation of Remote Control Device>

A configuration and an operation of the remote control device according to Embodiment 4 will be described.

Figure 9:
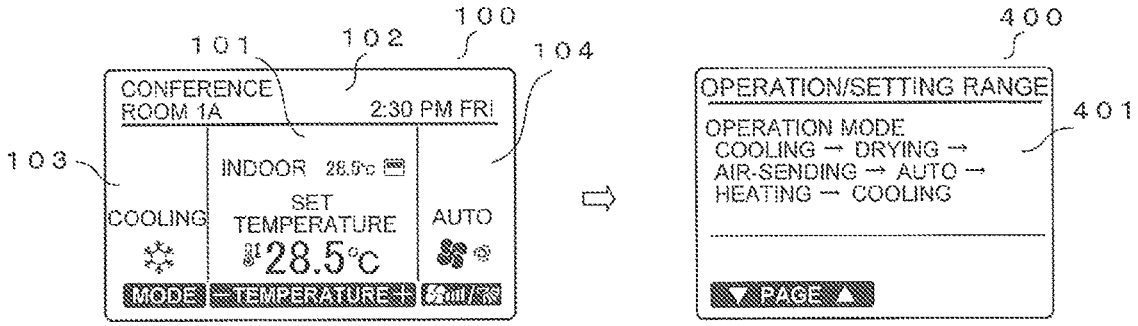
FIG. 9 is a diagram for explaining an operation of a display unit of a remote control device according to Embodiment 4.

FIG. 9 is a diagram for explaining an operation of a display unit of the remote control device according to Embodiment 4.

As illustrated in FIG. 9, when the user or the like presses the function button 24 for changing the operation mode in a specific pressing manner registered in advance (for example, single pressing, continuous pressing for three seconds, double pressing, or other types of pressing) in the state in which the main screen 100 is being displayed on the display unit 3, the display unit 3 displays an operation mode setting type display screen 400 that displays the type of operation mode that may be set by the user or the like.

In a central section 401 of the operation mode setting type display screen 400, individual operation modes are listed in order so that the order of transition of displayed operation mode may be presented when the function button 24 for changing the operation mode is repeatedly pressed. At this time, the currently set operation mode may be displayed with emphasis. For example, when the operation mode setting type display screen 400 is displayed in the state in which cooling (cooling operation) is set as the operation mode, the letters "cooling" may be displayed in a flashing manner. With this operation, the user or the like is able to understand the currently set operation mode, without returning to the previous screen.

<Effects of Remote Control Device>

Effects of the remote control device according to Embodiment 4 will be described.

In the remote control device 1, the user or the like is able to change the operation mode after confirming the type of operation mode that may be set and the display order for setting the operation mode. Therefore, the situation in which the user or the like unnecessarily presses a button or presses a button tentatively or other situations are suppressed even in the case where the type of operation mode that may be set or the display order for setting the operation mode varies according to the apparatus connected to the remote control device 1, and the efficiency of a setting operation may thus be improved. Furthermore, the user or the like is able to display the operation mode setting type display screen 400 with a simple operation in the state in which the main screen 100 is being displayed, without operating the air-conditioning apparatus or the like. Therefore, the efficiency of an operation for confirming the type of operation mode that may be set and the display order of operation modes may be improved. Furthermore, on the operation mode setting type display screen 400, the user or the like is able to understand the currently set operation mode. Therefore, a complicated operation such as switching of the screen may be reduced, and the efficiency of a setting operation and a confirmation operation may thus be improved.

Embodiment 5

A remote control device according to Embodiment 5 will be described.

Hereinafter, redundant explanations and explanations similar to Embodiment 1 to Embodiment 4 will be simplified or omitted in an appropriate manner.

<Configuration and Operation of Remote Control Device>

A configuration and an operation of the remote control device according to Embodiment 5 will be described.

When the user or the like moves the cursor 202 to a position beside the letters "wind direction/louver/ventilation operation" and presses the determination button 25 in the state in which the menu screen 200 illustrated in FIG. 4 is being displayed, the display unit 3 displays a wind direction, louver, and ventilation setting screen 500. The contents of the wind direction, louver, and ventilation setting screen 500 may be displayed on the main screen 100. In such a case, the operation explained below is performed in the state in which the main screen 100 is being displayed. The wind direction, louver, and ventilation setting screen 500 corresponds to an "operation screen" according to the present invention.

The wind direction, louver, and ventilation setting screen 500 is divided into a left section 501, a central section 502, a right section 503, and an upper section 504. In the left section 501, the state in which a swing mode where the wind direction is variable is set, the state in which a fixed mode where the wind direction is not variable is set, the setting state of the wind direction in the fixed mode, and other information are displayed. In the central section 502, the setting state of a ventilation operation and other information are displayed. In the right section 503, the setting state of a louver and other information are displayed.

Figure 10:
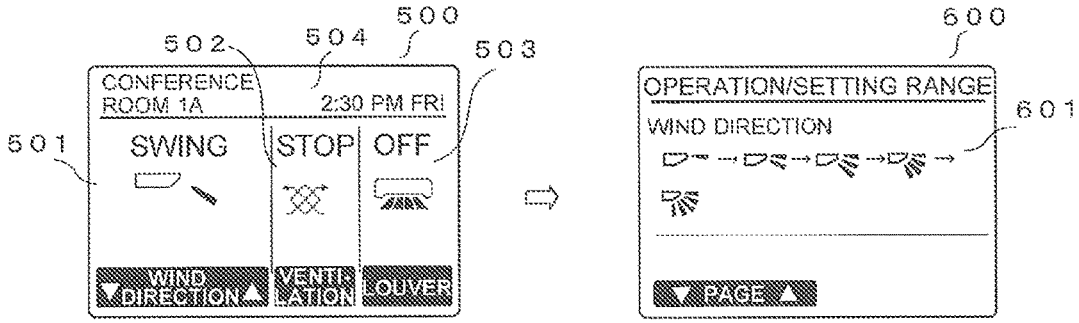
FIG. 10 is a diagram for explaining an operation of a display unit of a remote control device according to Embodiment 5.

FIG. 10 is a diagram for explaining an operation of a display unit of the remote control device according to Embodiment 5.

As illustrated in FIG. 10, when the user or the like presses the function button 24 for changing the wind direction in a specific pressing manner registered in advance (for example, single pressing, continuous pressing for three seconds, double pressing, simultaneous pressing of the function button 24 that is located below an "upside down triangle" displayed as a void character and the function button 24 that is located below a "triangle" displayed as a void character, or other types of pressing) in the state in which the wind direction, louver, and ventilation setting screen 500 is being displayed on the display unit 3, the display unit 3 displays a wind direction setting type display screen 600 that displays the wind direction that may be set by the user or the like.

In a central section 601 of the wind direction setting type display screen 600, individual diagrams that indicate corresponding wind directions are listed in order so that the order of transition of displayed wind direction may be presented when the function button 24 for changing the wind direction is repeatedly pressed. At this time, the diagram that corresponds to the currently set wind direction may be displayed with emphasis. Furthermore, if the swing mode is set, the letters "swinging" or other letters may be displayed. If the fixed mode is set, the letters "fixed" or other letters may be displayed. With this operation, the user or the like is able to understand the currently set wind direction and mode, without returning to the previous screen.

<Effects of Remote Control Device>

Effects of the remote control device according to Embodiment 5 will be described.

In the remote control device 1, the user or the like is able to change the wind direction after confirming the type of wind direction that may be set and the display order for setting the wind direction. Therefore, the situation in which the user or the like unnecessarily presses a button or presses a button tentatively or other situations are suppressed even in the case where the type of wind direction that may be set or the display order for setting the wind direction varies according to the apparatus connected to the remote control device 1, and the efficiency of a setting operation may thus be improved. Furthermore, the user or the like is able to display the wind direction setting type display screen 600 with a simple operation in the state in which the wind direction, louver, and ventilation setting screen 500 is being displayed, without operating the air-conditioning apparatus or the like. Therefore, the efficiency of an operation for confirming the type of wind direction that may be set and the display order for setting the wind direction may be improved. Furthermore, on the wind direction setting type display screen 600, the user or the like is able to understand the currently set wind direction and mode. Therefore, a complicated operation such as switching of the screen may be reduced, and the efficiency of a setting operation and a confirmation operation may thus be improved.

Embodiment 6

A remote control device according to Embodiment 6 will be described.

Hereinafter, redundant explanations and explanations similar to Embodiment 1 to Embodiment 5 will be simplified or omitted in an appropriate manner.

<Configuration and Operation of Remote Control Device>

A configuration and an operation of the remote control device according to Embodiment 6 will be described.

Figure 11:
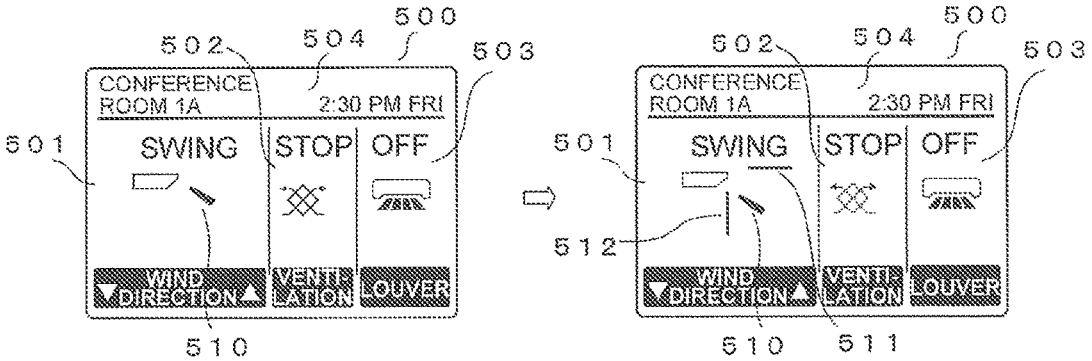
FIG. 11 is a diagram for explaining an operation of a display unit of a remote control device according to Embodiment 6.
Figure 12:
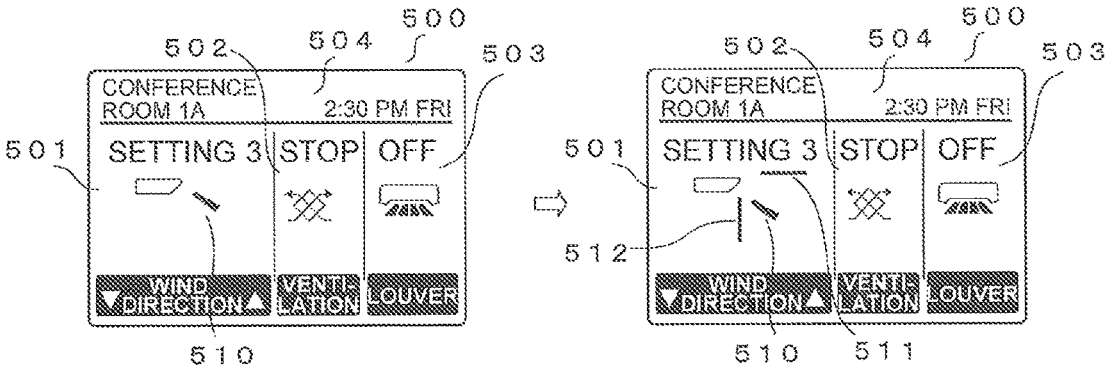
FIG. 12 is a diagram for explaining an operation of the display unit of the remote control device according to Embodiment 6.

FIGS. 11 and 12 are diagrams for explaining operations of a display unit of the remote control device according to Embodiment 6.

As illustrated in FIGS. 11 and 12, in the case where the swing mode is set or the wind direction at one of multiple stages (for example, five stages) is set in the fixed mode, when the user or the like presses the function button 24 for changing the wind direction in a specific pressing manner registered in advance (for example, single pressing, continuous pressing for three seconds, double pressing, simultaneous pressing of the function button 24 that is located below an "upside down triangle" displayed as a void character and the function button 24 that is located below a "triangle" displayed as a void character, or other types of pressing) in the state in which the wind direction, louver, and ventilation setting screen 500 is being displayed on the display unit 3, the display unit 3 displays a wind direction setting upper limit display line 511 and a wind direction setting lower limit display line 512 in parts outside a wind direction display diagram 510 that displays the wind direction. The wind direction setting upper limit display line 511 is displayed, for example, above the wind direction display diagram 510 that indicates the most upward wind direction. The wind direction setting lower limit display line 512 is displayed, for example, beside the wind direction display diagram 510 that indicates the most downward wind direction. Both when the swing mode is set and when the wind direction at one of the multiple stages (for example, five states) is set in the fixed mode, the wind direction setting upper limit display line 511 and the wind direction setting lower limit display line 512 may be displayed. The wind direction setting upper limit display line 511 and the wind direction setting lower limit display line 512 may be displayed in a flashing manner or a steady manner.

<Effects of Remote Control Device>

Effects of the remote control device according to Embodiment 6 will be described.

In the remote control device 1, the user or the like is able to change the wind direction after confirming the range of the wind direction that may be set. Therefore, the situation in which the user or the like unnecessarily presses a button or presses a button tentatively or other situations are suppressed, and the efficiency of a setting operation may thus be improved. Furthermore, the user or the like is able to display the wind direction setting upper limit display line 511 and the wind direction setting lower limit display line 512 with a simple operation in the state in which the wind direction, louver, and ventilation setting screen 500 is being displayed, without operating the air-conditioning apparatus or the like. Therefore, the efficiency of an operation for confirming the range of the wind direction that may be set may be improved. Furthermore, on the wind direction, louver, and ventilation setting screen 500, the user is able to understand the range of the wind direction that may be set. Therefore, a complicated operation such as switching of the screen may be reduced, and the efficiency of a setting operation and a confirmation operation may thus be improved.

Embodiment 7

A remote control device according to Embodiment 7 will be described.

Hereinafter, redundant explanations and explanations similar to Embodiment 1 to Embodiment 6 will be simplified or omitted in an appropriate manner.

<Configuration and Operation of Remote Control Device>

A configuration and an operation of the remote control device according to Embodiment 7 will be described.

Figure 13:
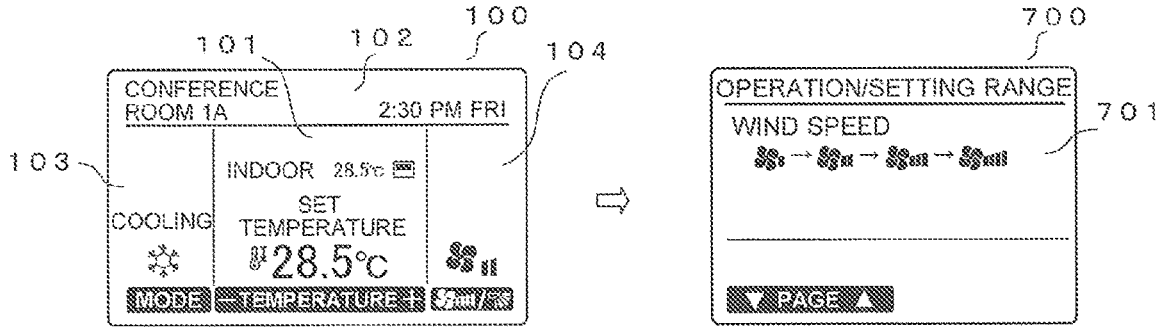
FIG. 13 is a diagram for explaining an operation of a display unit of a remote control device according to Embodiment 7.

FIG. 13 is a diagram for explaining an operation of a display unit of the remote control device according to Embodiment 7.

As illustrated in FIG. 13, when the user or the like presses the function button 24 for changing the wind speed in a specific pressing manner registered in advance (for example, single pressing, continuous pressing for three seconds, double pressing, or other types of pressing) in the state in which the main screen 100 is being displayed on the display unit 3, the display unit 3 displays a wind speed setting type display screen 700 that displays the type of wind speed that may be set by the user or the like. A void character in the right section 104 of the main screen 100 may be "'upside down triangle' wind speed 'triangle'" or the like. In such a case, the above-mentioned specific pressing registered in advance may be simultaneous pressing of the function button 24 that is located blow an "upside down triangle" displayed as a void character and the function button 24 that is located below a "triangle" displayed as a void character.

In a central section 701 of the wind speed setting type display screen 700, individual diagrams that indicate corresponding wind speeds are listed in order so that the order of transition of displayed wind direction may be presented when the function button 24 for changing the wind direction is repeatedly pressed. At this time, the currently set wind speed may be displayed with emphasis. Furthermore, if an automatic mode where the wind speed is automatically set is set, the letters "automatic mode" or other letters may be displayed. With this operation, the user or the like is able to understand the currently set wind speed and mode, without returning to the previous screen.

<Effects of Remote Control Device>

Effects of the remote control device according to Embodiment 7 will be described.

In the remote control device 1, the user or the like is able to change the wind direction after confirming the type of wind speed that may be set and the display order for setting the wind speed. Therefore, the situation in which the user or the like unnecessarily presses a button or presses a button tentatively or other situations are suppressed even in the case where the type of wind speed that may be set or the display order for setting the wind speed varies according to the apparatus connected to the remote control device 1, and the efficiency of a setting operation may thus be improved. Furthermore, the user or the like is able to display the wind speed setting type display screen 700 with a simple operation in the state in which the main screen 100 is being displayed, without operating the air-conditioning apparatus or the like. Therefore, the efficiency of an operation for confirming the type of wind speed that may be set and the display order of wind speeds may be improved. Furthermore, on the wind speed setting type display screen 700, the user or the like is able to understand the currently set wind speed and mode. Therefore, a complicated operation such as switching of the screen may be reduced, and the efficiency of a setting operation and a confirmation operation may thus be improved.

Embodiment 8

A remote control device according to Embodiment 8 will be described.

Hereinafter, redundant explanations and explanations similar to Embodiment 1 to Embodiment 7 will be simplified or omitted in an appropriate manner.

<Configuration and Operation of Remote Control Device>

A configuration and an operation of the remote control device according to Embodiment 8 will be described.

Figure 14:
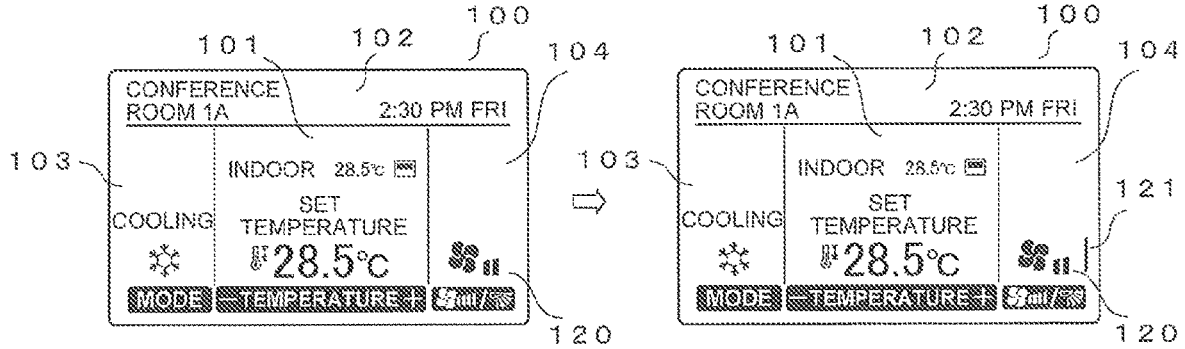
FIG. 14 is a diagram for explaining an operation of a display unit of a remote control device according to Embodiment 8.

FIG. 14 is a diagram for explaining an operation of a display unit of the remote control device according to Embodiment 8.

As illustrated in FIG. 14, in the case where the wind speed at one of multiple stages (for example, four stages) is set or the automatic mode is set, when the user or the like presses the function button 24 for changing the wind speed in a specific pressing manner registered in advance (for example, single pressing, continuous pressing for three seconds, double pressing, or other types of pressing) in the state in which the main screen 100 is being displayed on the display unit 3, the display unit 3 displays a wind speed setting upper limit display line 121 in a part outside a wind speed display diagram 120 that displays the wind speed. The wind speed setting upper limit display line 121 is displayed, for example, beside the wind speed display diagram 120 that indicates the highest wind speed. Both when the wind speed at one of the multiple stages (for example, four stages) is set and when the automatic mode is set, the wind speed setting upper limit display line 121 may be displayed. The wind speed setting upper limit display line 121 may be displayed in a flashing manner or a steady manner.

<Effects of Remote Control Device>

Effects of the remote control device according to Embodiment 8 will be described.

In the remote control device 1, the user or the like is able to change the wind speed after confirming the range of the wind speed that may be set. Therefore, the situation in which the user or the like unnecessarily presses a button or presses a button tentatively or other situations are suppressed, and the efficiency of a setting operation may thus be improved.

Furthermore, the user or the like is able to display the wind speed setting upper limit display line 121 with a simple operation in the state in which the main screen 100 is being displayed, without operating the air-conditioning apparatus or the like. Therefore, the efficiency of an operation for confirming the range of the wind speed that may be set may be improved. Furthermore, on main screen 100, the user or the like is able to understand the range of the wind speed that may be set. Therefore, a complicated operation such as switching of the screen may be reduced, and the efficiency of a setting operation and a confirmation operation may thus be improved.

Embodiment 9

A remote control device according to Embodiment 9 will be described.

Hereinafter, redundant explanations and explanations similar to Embodiment 1 to Embodiment 8 will be simplified or omitted in an appropriate manner.

<Configuration and Operation of Remote Control Device>

A configuration and an operation of the remote control device according to Embodiment 9 will be described.

Figure 15:
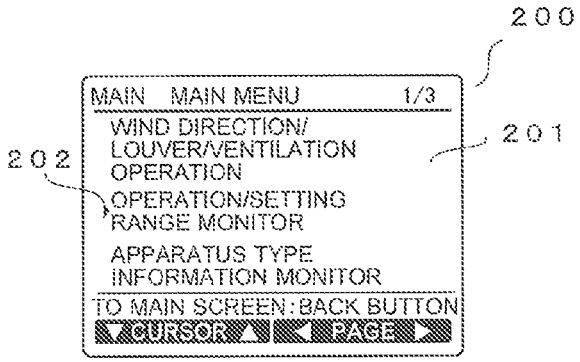
FIG. 15 is a diagram illustrating an example of a menu screen displayed on a display unit of a remote control device according to Embodiment 9.

FIG. 15 is a diagram illustrating an example of a menu screen displayed on a display unit of the remote control device according to Embodiment 9.

When the user or the like presses the menu button 22, the display unit 3 displays a menu screen 200, as illustrated in FIG. 15.

Figure 16:
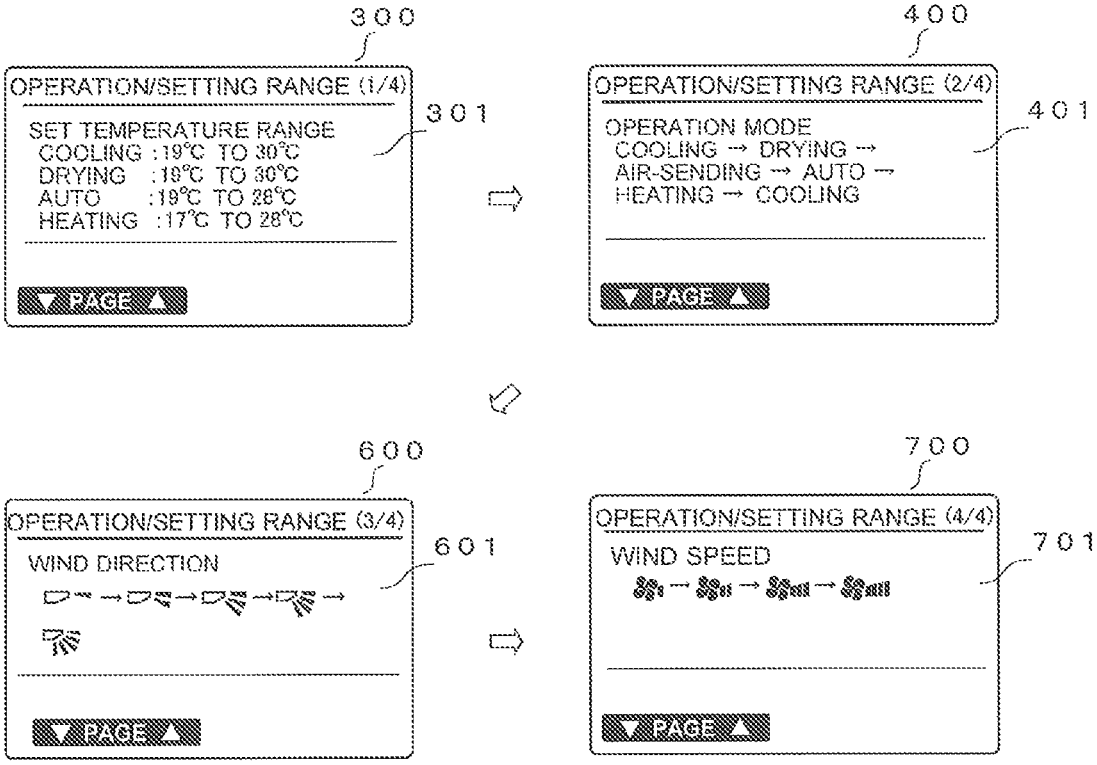
FIG. 16 is a diagram for explaining an operation of the display unit of the remote control device according to Embodiment 9.

FIG. 16 is a diagram for explaining an operation of the display unit of the remote control device according to Embodiment 9.

When the user or the like moves the cursor 202 to a position beside the letters "operation/setting range monitor" and presses the determination button 25 in the state in which the menu screen 200 is being displayed, the display unit 3 displays the set temperature setting range display screen 300, as illustrated in FIG. 16. On the set temperature setting range display screen 300, when the user or the like repeatedly presses the function button 24 that is located below an "upside down triangle" displayed as a void character, the set temperature setting range display screen 300 is switched to the operation mode setting type display screen 400, the wind direction setting type display screen 600, and the wind speed setting type display screen 700, and then returns to the set temperature setting range display screen 300. When the user or the like presses the function button 24 that is located below a "triangle" displayed as a void character, the screen is switched in the inverse order.

<Effects of Remote Control Device>

Effects of the remote control device according to Embodiment 9 will be described.

In the remote control device 1, after the main screen 100 is switched to the menu screen 200, the user or the like is able to collectively confirm the range and type that may be set for individual settings as a series of screens. Therefore, the user or the like is able to easily confirm the range and type that may be set for the individual settings, without operating the connected air-conditioning apparatus or the like, and the efficiency of a setting operation and a confirmation operation may thus be improved.

Embodiment 10

A remote control device according to Embodiment 10 will be described.

Hereinafter, redundant explanations and explanations similar to Embodiment 1 to Embodiment 9 will be simplified or omitted in an appropriate manner.

<Configuration and Operation of Remote Control Device>

A configuration and an operation of the remote control device according to Embodiment 10 will be described.

Figure 17:
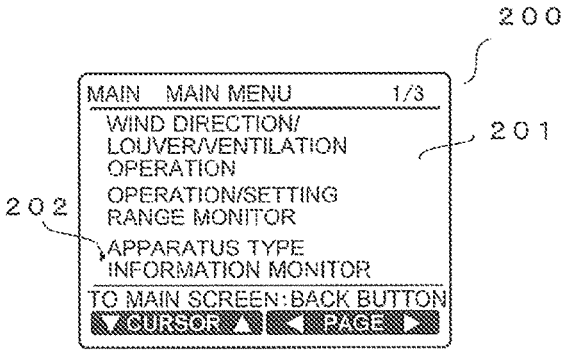
FIG. 17 is a diagram illustrating an example of a menu screen displayed on a display unit of a remote control device according to Embodiment 10.

FIG. 17 is a diagram illustrating an example of a menu screen displayed on a display unit of the remote control device according to Embodiment 10.

When the user or the like presses the menu button 22, the display unit 3 displays a menu screen 200, as illustrated in FIG. 17.

Figure 18:
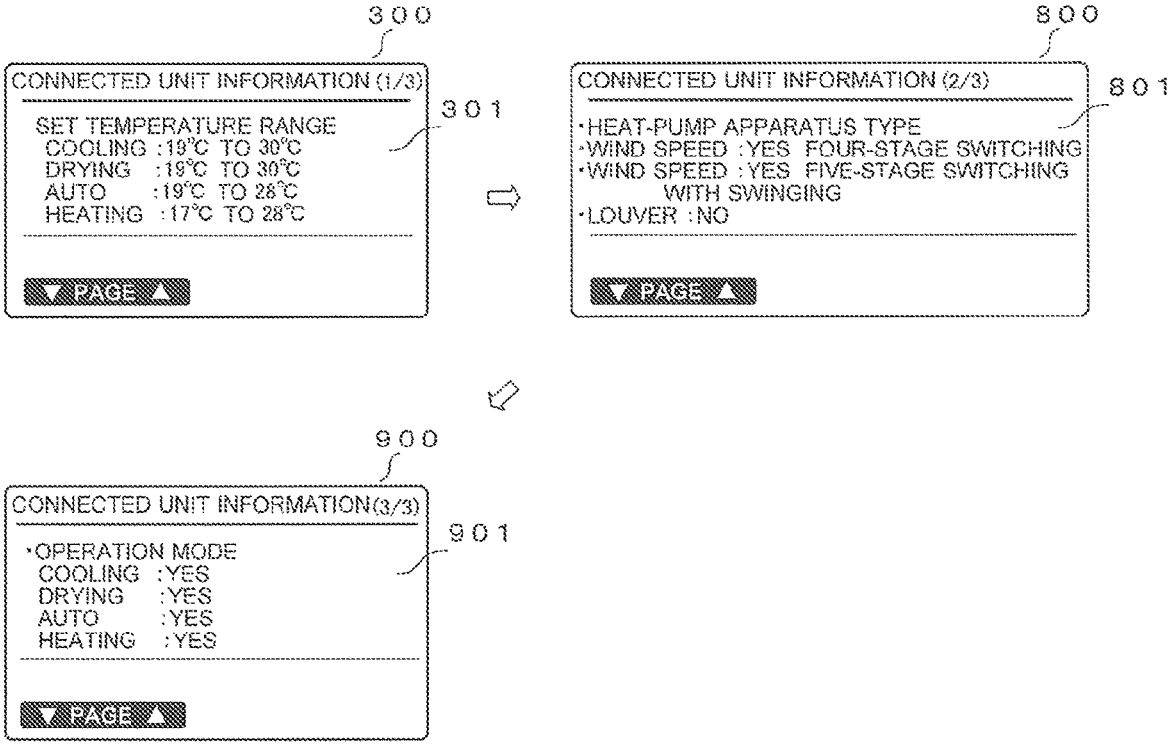
FIG. 18 is a diagram for explaining an operation of the display unit of the remote control device according to Embodiment 10.

FIG. 18 is a diagram for explaining an operation of the display unit of the remote control device according to Embodiment 10.

When the user or the like moves the cursor 202 to a position beside the letters "connected unit information" and presses the determination button 25 in the state in which the menu screen 200 is being displayed, the display unit 3 displays the set temperature setting range display screen 300, as illustrated in FIG. 18. On the set temperature setting range display screen 300, when the user or the like repeatedly presses the function button 24 that is located below an "upside down triangle" displayed as a void character, the set temperature setting range display screen 300 is switched to an apparatus type/function information display screen 800 and an operation mode information display screen 900, and then returns to the set temperature setting range display screen 300. When the user or the like presses the function button 24 that is located below a "triangle" displayed as a void character, the screen is switched in the inverse order.

On the apparatus type/function information display screen 800, for example, apparatus type information on the connected air-conditioning apparatus or the like, permission/prohibition of setting of wind speed and the number of stages that may be set, permission/prohibition of wind direction and the number of stages that may be set, presence/absence of a swing mode, presence/absence of a louver, and other information are displayed. On the operation mode information display screen 900, for example, presence/absence of each operation mode and other information are displayed.

<Effects of Remote Control Device>

Effects of the remote control device according to Embodiment 10 will be described.

In the remote control device 1, after the main screen 100 is switched to the menu screen 200, the user or the like is able to collectively confirm the specifications of the connected air-conditioning apparatus or the like and the range of setting that may be set as a series of screens. Therefore, the user or the like is able to easily confirm the specifications of the connected air-conditioning apparatus or the like and the rage of setting that may be set, without operating the connected air-conditioning apparatus or the like, and the efficiency of a setting operation and a confirmation operation may thus be improved.

Embodiments 1 to 10 have been described above. However, the present invention is not limited to the explanation for the above embodiments. For example, all or parts of the above embodiments may also be combined together. Furthermore, the contents explained for Embodiments 1 to 10 may be replaced with settings for other operations of the air-conditioning apparatus or the like.

REFERENCE SIGNS LIST

1: remote control device, 2: operation unit, 3 display unit, 4 controller, 4*a*: screen generator, 5: transmission/reception unit, 21: operation/stop button, 22: menu button, 23: back button, 24: function button, 25: determination button, 100: main screen, 101: central section, 102: upper section, 103: left section, 104: right section, 110: set temperature setting range display part, 120: wind speed display diagram, 121: wind speed setting upper limit display line, 200: menu screen, 201: item display section, 202: cursor, 300: set temperature setting range display screen, 301: central section, 400: operation mode setting type display screen, 401: central section, 500: wind direction/louver/ventilation setting screen, 501: left section, 502: central section, 503: right section, 504: upper section, 510: wind direction display diagram, 511: wind direction setting upper limit display line, 512: wind direction setting lower limit display line, 600: wind direction setting type display screen, 601: central section, 700: wind speed setting type display screen, 701: central section, 800: apparatus type information/function information display screen, 900: operation mode information display screen.

The invention claimed is:

1. A remote control device comprising:

an operation unit, including a button, configured to switch and set, in response to a manipulation of the button by a user, at least one operation state of an air-conditioning apparatus performing heating and cooling of air, the operation state including settings and operations of the air-conditioning apparatus;

a display unit including a screen; and a controller configured to control the display unit to display on the screen the at least one operation state of the air-conditioning apparatus and/or switching and setting of the at least one operation state by the operation unit, wherein the controller controls the display unit to display on the screen, as a list of a plurality of elements, the at least one operation state including:

(i) a plurality of operation modes including a heating mode, a cooling mode, a drying mode, and an automatic determination mode, and (ii) a plurality of numerical ranges of temperature to which the air-conditioning apparatus heats or cools airs.

2. The remote control device of claim 1, wherein the controller controls the display unit to further display, as a list of a plurality of elements, the at least one operation state further including (iii) a plurality of wind directions that are directions at which air is blown from the air conditioning apparatus, and (iv) a plurality of wind speeds that are speeds at which air is blown from the air conditioning apparatus.

3. The remote control device of claim 2, wherein the controller controls the display unit to display on the screen in sequential order the plurality of operation modes, the plurality of wind directions, and the plurality of wind speeds, and wherein the operation unit sets an operation mode, a wind direction, and a wind speed as the sequential order is displayed.

4. The remote control device of claim 1, wherein the controller controls the display unit to display on the screen in sequential order the plurality of numerical ranges of temperatures, the plurality of wind directions, and the plurality of wind speeds.

5. The remote control device of claim 1, wherein the controller controls the display unit to display on the screen, in a series of sequential images, the plurality of operation modes, the plurality of wind directions, the plurality of wind speeds, and air-conditioning apparatus type information that is hardware information of the air-conditioning apparatus.

6. The remote control device of claim 1, wherein the controller controls the display unit to display the plurality of numerical ranges of temperature to be respectively associated with the plurality of operation modes.

7. The remote control device of claim 1, wherein the button is at least one of a key or a soft key.

8. A remote control device comprising:

an operation unit, including a button, configured to switch and set, in response to a manipulation of the button by a user, at least one operation state of an air-conditioning apparatus performing heating and cooling of air, the operation state including settings and operations of the air-conditioning apparatus;

a display unit including a screen; and a controller configured to control the display unit to display on the screen the at least one operation state of the air-conditioning apparatus and/or the switching and setting of the at least one operation state by the operation unit, wherein the controller controls the display unit to display, as the at least one operation state, an upper limit of a numerical range of temperatures to which the air-conditioning apparatus heats or cools airs and a lower limit of the numerical range of temperatures.

* * * * *